US005787760A

United States Patent [19]

Thorlakson

[11] Patent Number: 5,787,760

[45] Date of Patent: Aug. 4, 1998

[54] METHOD AND FOOT PEDAL APPARATUS FOR OPERATING A MICROSCOPE

[76] Inventor: Richard G. Thorlakson, 2515 109th Ave. SE., Bellevue, Wash. 98004

[21] Appl. No.: 791,251

[22] Filed: Jan. 30, 1997

Related U.S. Application Data

[62] Division of Ser. No. 157,655, Nov. 24, 1993, abandoned.

[51] Int. Cl.[6] ..... G05G 1/14

[52] U.S. Cl. ..... 74/512; 74/560; 200/86.5

[58] Field of Search ..... 74/512, 560, 561, 74/562; 433/101; 200/86.5

[56] References Cited

U.S. PATENT DOCUMENTS

| | | | |
|---|---|---|---|
| 2,866,024 | 12/1958 | Ginn | 200/86.5 |
| 2,872,542 | 2/1959 | Thompson | 200/86.5 |
| 2,878,336 | 3/1959 | Ehrlich | 200/86.5 |
| 2,967,458 | 1/1961 | Stone, Jr. | 88/39 |
| 3,868,171 | 2/1975 | Hoppl | 350/85 |
| 3,983,344 | 9/1976 | Straihammer | 200/86.5 |
| 4,157,859 | 6/1979 | Terry | 350/35 |
| 4,168,707 | 9/1979 | Douvas et al. | 128/276 |
| 4,172,217 | 10/1979 | Miller | 200/86.5 |
| 4,354,838 | 10/1982 | Hoyer et al. | 433/101 |
| 4,403,123 | 9/1983 | Shek | 200/61.89 |
| 4,417,875 | 11/1983 | Matsui | 433/101 |
| 4,426,738 | 1/1984 | Sato | 455/603 |
| 4,523,911 | 6/1985 | Braetsch et al. | 433/101 |
| 4,798,535 | 1/1989 | Nielsen | 433/101 |
| 4,837,857 | 6/1989 | Scheller et al. | 455/617 |
| 5,019,076 | 5/1991 | Yamanashi et al. | 606/45 |
| 5,098,426 | 3/1992 | Sklar et al. | 606/5 |
| 5,351,571 | 10/1994 | Johnson | 74/478 |
| 5,423,231 | 6/1995 | Helfrich et al. | 74/561 |
| 5,535,642 | 7/1996 | Moll | 74/561 |

OTHER PUBLICATIONS

Catalog, pp. 20 and 56.
Catalog drawing.

*Primary Examiner*—Vinh T. Luong
*Attorney, Agent, or Firm*—Seed and Berry LLP

[57] ABSTRACT

A method and foot pedal control for operating a microscope. A foot of an operator is placed on a foot pedal and its movement in an upward or downward direction from a neutral position is detected, with the microscope being moved in the focus-up and focus-down directions in response thereto. Similarly, the rotational movement of the operator's foot in clockwise and counterclockwise directions from the neutral position is detected, and the microscope is moved in the zoom-in and zoom-out directions in response thereto. The non-rotational movement of the operator's foot in a horizontal plane from the neutral position is also detected and the microscope is moved in a corresponding direction to provide field-of-view control. The presence of the operator's foot on the foot pedal is detected to control operation of a microscope light. The foot pedal control includes a platform housing a base member movable relative thereto and on which a foot pedal is mounted for independent rotation in a horizontal plane. A forward portion of the foot pedal is independently rotatable in a vertical plane. Movement of the base member, the foot pedal and the foot pedal forward portion in their respective planes of movement is detected to control the field-of-view, magnification and focus of the microscope.

33 Claims, 5 Drawing Sheets

METHOD AND FOOT PEDAL APPARATUS FOR OPERATING A MICROSCOPE

CROSS-REFERENCE TO RELATED APPLICATION

This application is a divisional of U.S. patent application Ser. No. 08/157,655, filed Nov. 24, 1993, now abandoned.

TECHNICAL FIELD

The present invention relates generally to foot pedal controls used to control microscopes, and more particularly, to foot pedal controls used to provide focus, zoom and field-of-view controls for surgical microscopes.

BACKGROUND OF THE INVENTION

Microscopes are often used by surgeons to perform intricate surgical operations on patients. While the typical laboratory microscope is operated by hand controls to adjust focus and the magnification of the microscope, in a surgical setting the surgeon using the microscope has his/her hands occupied with other tasks and cannot use them for adjusting microscope controls. Further, unlike in the typical laboratory setting, surgical microscopes require control of the X–Y position of the microscope to adjust the microscope's field-of-view as the surgical operation progresses.

To accommodate the needs of the surgeon for hands-free operation, a variety of foot pedal controls have been developed for surgical microscopes. One such control is a pneumatic foot pedal that provides only X–Y adjustment of the field-of-view of the microscope. Other foot pedal controls provide separate foot pedals for zoom control and focus control. The use of separate foot pedals requires the surgeon to lift his/her foot off of one pedal and to blindly search with his/her foot for the other pedal when it is necessary to sequentially adjust the zoom and focus. This is because the surgeon frequently cannot take his/her eyes off of the surgical site being viewed through the microscope when adjustment is needed.

To overcome this problem, the two controls can be mounted in a single floor housing with a rest bar in between them. In one such device, focus-up and zoom-up switches are mounted adjacent to each other on one side of the rest bar, and focus-down and zoom-down switches are mounted adjacent to each other on the opposite side of the rest bar. With this arrangement, the surgeon can rest his/her foot on the rest bar and tilt his/her foot forward to depress one set of switches with his/her toes and tilt his/her foot rearward to depress the second set of switches with his/her heel. This requires the turning of the foot by a proper amount to depress the correct switch and assumes the surgeon will keep his/her foot in good alignment with the device. No X–Y position control is provided.

Another device incorporates zoom, focus and X–Y control into a single floor housing. It uses a joystick operated by the toes or ball of the surgeon's foot and many surgeons find it necessary to perform the surgical operation with at least one bare foot to have sufficiently sensitive control. The joystick is mounted in a forward portion of the floor housing, and the focus control and zoom control switches are located in a rearward portion of the housing. A foot rest bar is positioned between the focus and zoom control switches. In use, the often bare foot of the surgeon is positioned on the rest bar so that it can be tilted forward to actuate the focus control switch or tilted backward to actuate the zoom control switch, as needed to adjust the microscope. The focus and zoom control switches are rocker switches arranged with a left to right orientation. As such, to adjust the microscope in a focus-up direction the surgeon's foot must be turned to the right and then tilted forward with sufficient force to depress the right end of the focus control switch. Similarly, to adjust the microscope in a focus-down direction the surgeon's foot must be turned to the left and then tilted forward with sufficient force to depress the left end of the focus control switch. The same multiple movements are used to adjust the microscope in the zoom-in and zoom-out directions except that the foot is tilted backwards and the heel of the foot is used to depress the right or left end of the zoom control switch.

When it is necessary to adjust the X–Y position of the microscope, the surgeon must lift his/her foot off of the rest bar and blindly move it forward and about as necessary until he/she has located the joystick. Then, the surgeon must either grasp the joystick with his/her toes or rest the ball of his/her foot atop the joystick in order to move the joystick left and right, and forward and backward as needed to adjust the field-of-view of the microscope. Experience has shown that controlling a joystick in this manner quickly and with accuracy is difficult for most surgeons. Again, all of this must be accomplished by the surgeon without taking his/her eyes off the surgical site being viewed through the microscope. When adjustment of the field-of-view is complete, the surgeon must lift his/her foot up and blindly move it back to the rest bar. The foot movements required of the surgeon when using this device take time, detract the attention of the surgeon from his/her main surgical task, and present the possibility of adjustment errors and injury to the patient.

Another drawback of these devices is that none provides a foot pedal control that allows the surgeon to select between various speeds for focus, zoom and X–Y adjustments. Many surgical microscopes provide variable speeds; however, this selection typically is accomplished using a hand operated switch mounted on the microscope, thus requiring the surgeon to move his/her hand from whatever other tasks he/she is performing or to verbally communicate instructions to an assistant.

A significant need exists for a foot pedal control for surgical and other type microscopes that provides hands-free operation and which is more convenient, easier, quicker and accurate to operate. The control should minimize foot movements required and eliminate the need to lift the foot from the foot pedal to accomplish focus, zoom, and field-of-view control. Multiple functions should be achievable with a single directional movement of the foot. The present invention provides such a foot pedal control.

SUMMARY OF THE INVENTION

The present invention resides in a method and foot pedal apparatus for operating a microscope. The method operates a microscope adjustably movable to focus up and down to provide focus control using a foot pedal control. The method includes positioning a foot of an operator on the foot pedal control, detecting movement of the operator's foot in an upward direction from a neutral position whereat no adjustable movement of the microscope occurs, and detecting movement of the operator's foot in a downward direction from the neutral position. The method further includes actuating movement of the microscope in one of the focus-up and focus-down directions in response to detecting movement of the operator's foot in the upward direction, and actuating movement of the microscope in the other of the focus-up and focus-down directions in response to detecting movement of the operator's foot in the downward direction.

The method is applicable to a microscope adjustably movable to zoom-in and zoom-out to provide magnification control using the foot pedal control. The method includes detecting rotational movement of the operator's foot in a clockwise direction from the neutral position, and detecting rotational movement of the operator's foot in a counterclockwise direction from the neutral position. Further included is actuating movement of the microscope in one of the zoom-in and zoom-out directions in response to detecting movement of the operator's foot in the clockwise direction, and actuating movement of the microscope in the other of the zoom-in and zoom-out directions in response to detecting movement of the operator's foot in the counterclockwise direction.

The method is also useful with a microscope adjustably movable within a microscope adjustment plane to provide field-of-view control by detecting a direction of non-rotational movement of the operator's foot in a foot movement plane from the neutral position. The method further includes actuating movement of the microscope in the microscope adjustment plane in a direction corresponding to the detected direction of non-rotational movement of the operator's foot in the foot movement plane from the neutral position. In an illustrated embodiment, the field-of-view control is provided by detecting non-rotational movement of the operator's foot in left, right, forward and rearward directions.

The method further includes detecting if the operator's foot is on or off the foot pedal control. If the operator's foot is detected as being on the foot pedal control, a microscope light is turned on, and if the operator's foot is detected as being off the foot pedal control, the microscope light is turned off.

For speed control the movement of the operator's foot from the neutral position to a first position is detected, as is the movement of the operator's foot in the same direction beyond the first position. By detecting these movements, the microscope field-of-view, focus and magnification speeds can be selected.

The foot pedal control includes a platform having forward and rearward ends, and left and right sides. A base member is movably mounted on the platform to permit its movement relative to the platform within a generally horizontal plane. A first sensor is electrically connectable to the microscope to actuate movement thereof in a microscope horizontal adjustment plane. In response to sensing movement of the base member in the base member horizontal plane relative to the platform, the first sensor generates a first control signal to produce movement of the microscope in the microscope horizontal adjustment plane corresponding to the sensed movement of the base member.

A foot pedal is positioned above the base member. The foot pedal has a rearward contact portion for placement of a heel portion of the user's foot thereon, and a forward foot engagement portion for engagement with a forward portion of the user's foot. The foot pedal is attached to the base member to permit clockwise and counterclockwise horizontal rotational movement relative thereto independent of the base member, and to transmit non-rotational movements of the user's foot in a horizontal plane to the base member to produce corresponding movement of the base member relative to the platform. The foot pedal is also movable upward and downward relative to the base member in response to upward and downward movements of the user's foot applied to the foot pedal.

Second and third sensors are provided which are electrically connectable to the microscope. In response to sensing one of the clockwise and counterclockwise horizontal movements of the foot pedal relative to the base member, the second sensor generates a second control signal indicative of the direction of the clockwise and counterclockwise horizontal movements sensed. In response to sensing one of the upward and downward movements of the foot pedal relative to the base member, the third sensor generates a third control signal indicative of the direction of the upward and downward movement sensed. One of the second and third control signals produces movement of the microscope in a corresponding one of the zoom-in and zoom-out directions, and the other of the second and third control signal produces movement of the microscope in a corresponding one of the focus-up and focus-down directions. In one of the illustrated embodiments, the sensors comprise a plurality of switches. Dual switches are used to indicate both slow and fast directional movement for the microscope.

The foot pedal control is usable with a microscope light. A rearward foot pedal portion includes a lower portion to which the forward foot pedal portion is attached. The rearward portion has a contact plate vertically movable relative to the rearward lower portion. The foot pedal control further includes a light switch electrically connected with the microscope to turn the microscope light on in response to the user's foot being on the contact plate and to turn the microscope light off in response to the user's foot being off the contact plate. A foot-activated control switch mounted on the platform and electrically connected to the light switch selectively activates and deactivates the light switch.

Other features and advantages of the invention will become apparent from the following detailed description, taken in conjunction with the accompanying drawings.

DETAILED DESCRIPTION OF THE INVENTION

Figure 1:
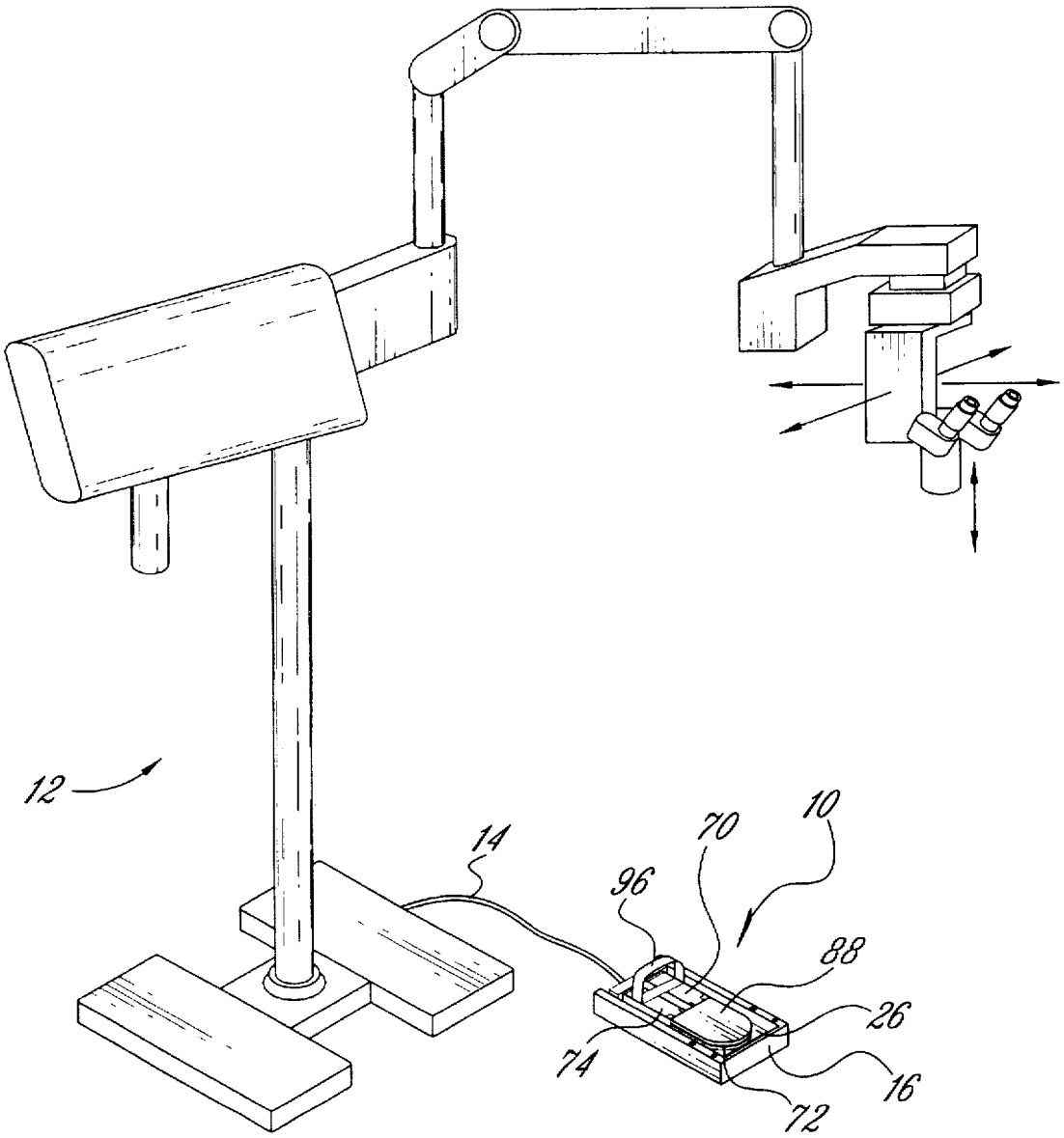
FIG. 1 is an isometric view of a foot pedal control embodying the present invention connected to a surgical microscope.

As shown in FIG. 1 of the drawings, the present invention is embodied in a foot pedal control, indicated generally by reference numeral 10, connectable to a surgical microscope 12 by an electrical cable 14. The microscope 12 is a conventional surgical microscope adjustably movable in the left and right directions, and in the forward and rearward directions, to provide field-of-view control; adjustably movable to zoom in and out to provide magnification control; and adjustably movable to focus up and down to provide focus control. The microscope may or may not have variable operating speeds for each of the field-of-view control, the magnification control and the focus control.

The foot pedal control 10 of the present invention provides an operator, typically a surgeon, with hands-free multi-directional field-of-view control, zoom-in and out magnification control, and focus up and down focus control of the microscope 12. All of this is achieved without the operator having to remove his/her foot from the foot pedal control and with a single directional movement of the foot. Furthermore, without removing his/her foot from the foot pedal control, the operator can select a slow or fast operating speed for the field-of-view control, magnification control and focus control. Additionally, the operator can turn the microscope light off and on without removing his/her foot from the foot pedal control. Thus, the operator is provided with more convenient, easier, quicker and accurate hands-free operation of the microscope. The need to lift the foot from its position on the foot pedal control and to search blindly with the foot for switches to achieve this microscope control, is eliminated.

Figure 2B:
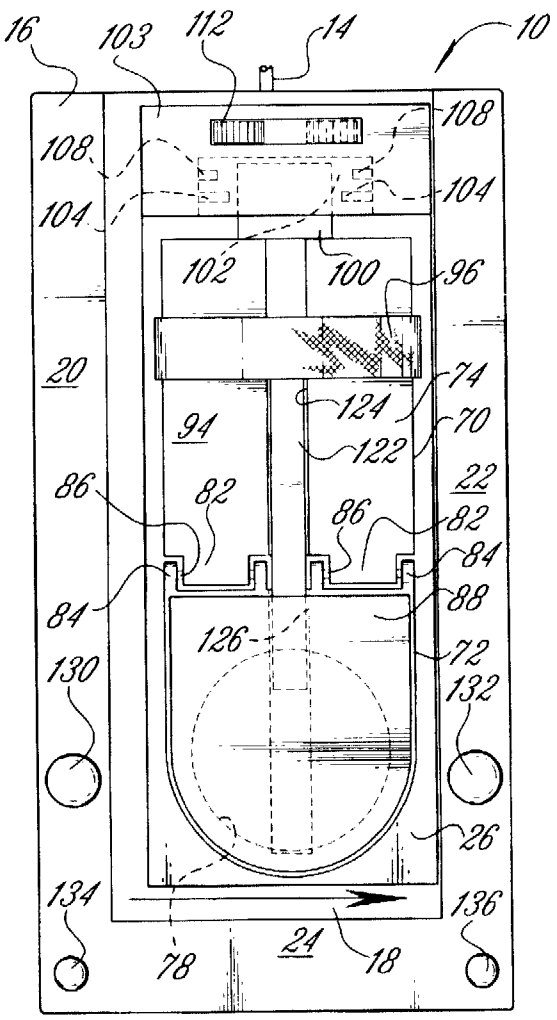
FIG. 2B is a top plan view of the foot pedal control of FIG. 2 with the foot pedal and base member shown moved to a rightward position.
Figure 2A:
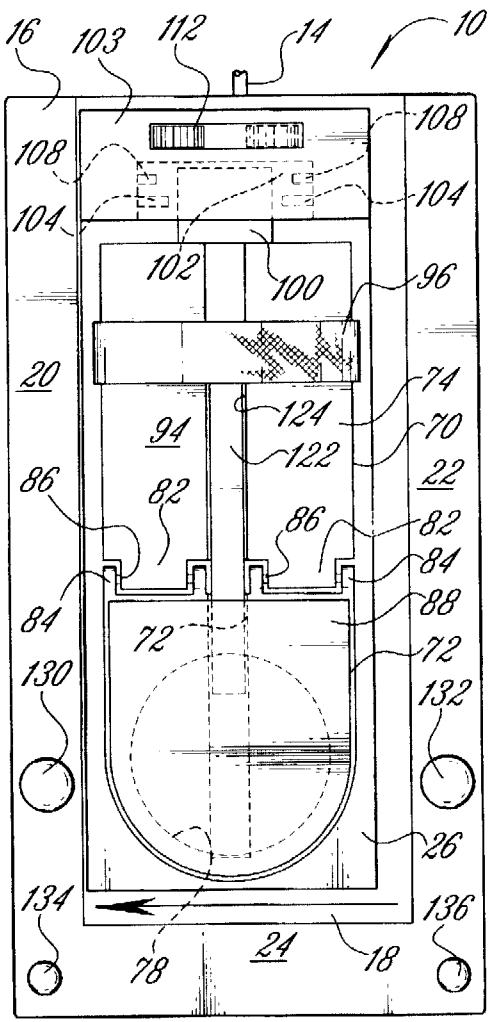
FIG. 2A is a top plan view of the foot pedal control of FIG. 2 with the foot pedal and base member shown moved to a leftward position.
Figure 2:
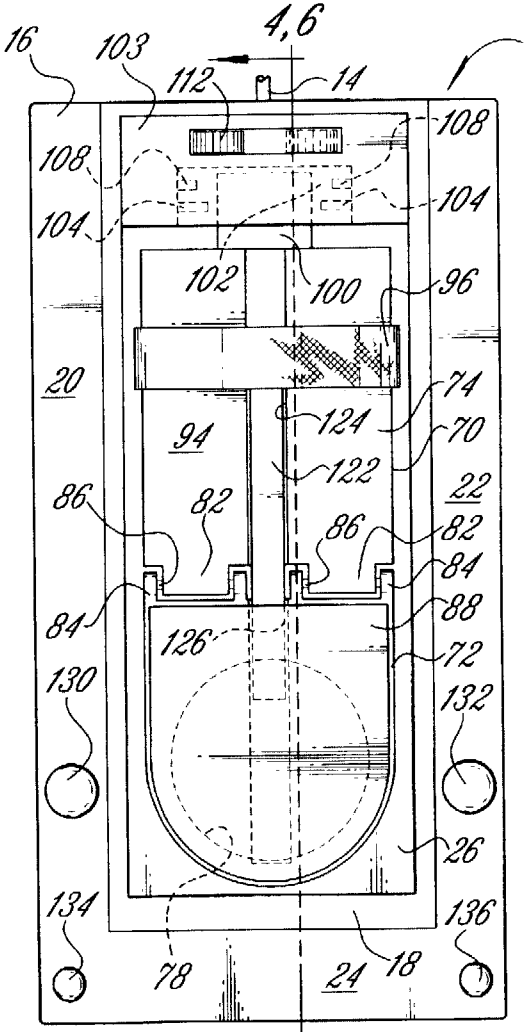
FIG. 2 is an enlarged top plan view of the foot pedal control of FIG. 1 shown with the foot pedal and base member in a neutral position.
Figure 3A:
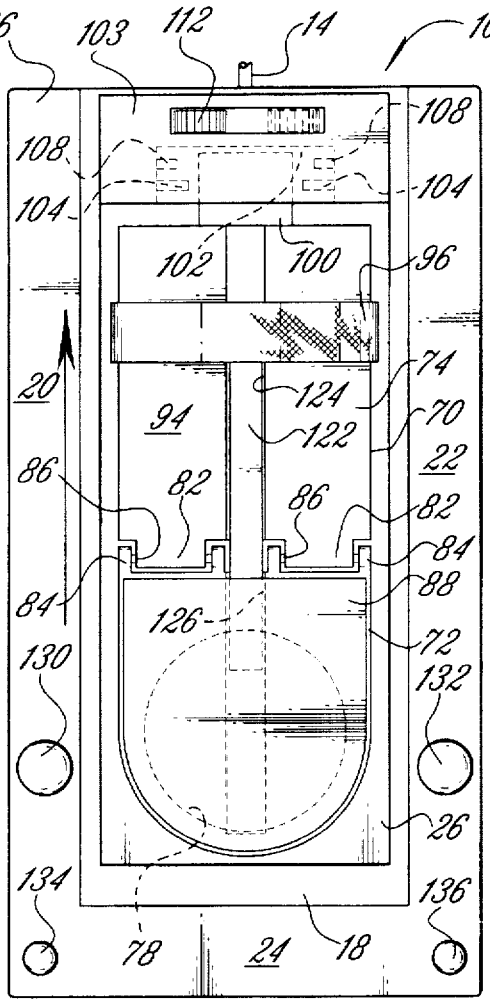
FIG. 3A is a top plan view of the foot pedal control of FIG. 2 with the foot pedal and base member shown moved to a forward position.
Figure 3B:
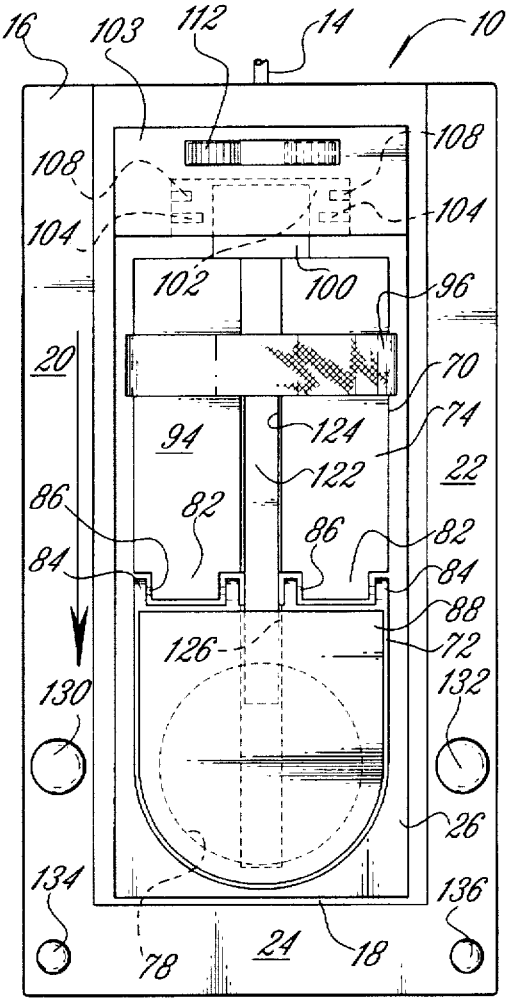
FIG. 3B is a top plan view of the foot pedal control of FIG. 2 with the foot pedal and base member shown moved to a rearward position.
Figure 4:
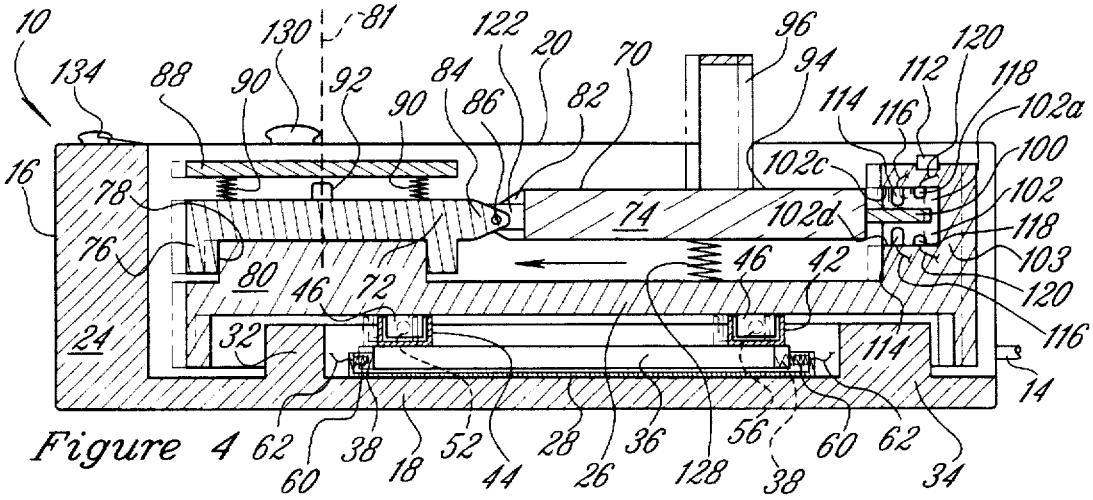
FIG. 4 is a cross-sectional view taken substantially long line 4—4 of FIG. 2 with rearward movement of the foot pedal and base member being shown in phantom line.
Figure 6:
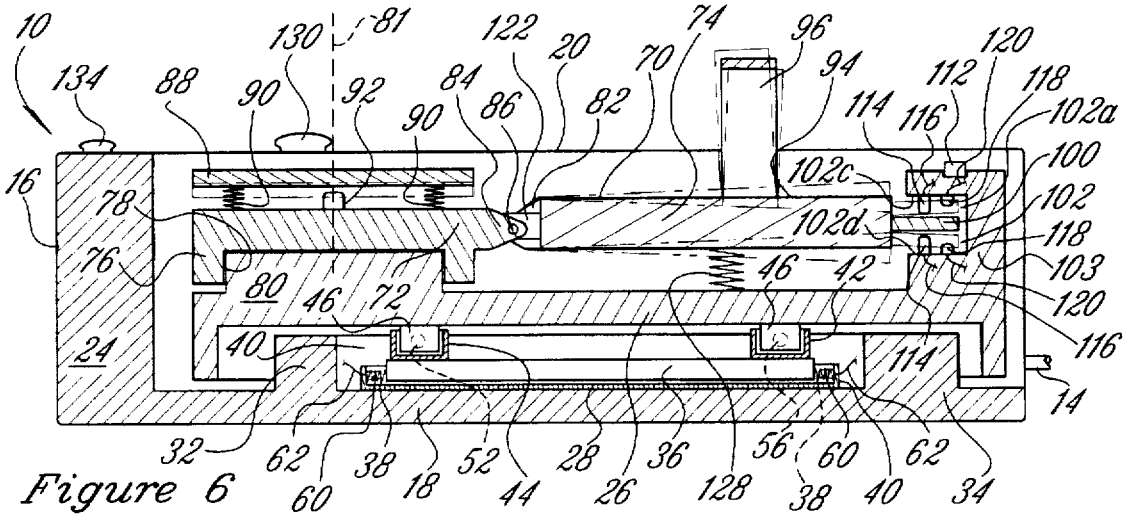
FIG. 6 is a cross-sectional view taken substantially along line 6—6 of FIG. 2 showing the forward portion of the foot pedal in both the raised and lowered positions in phantom line, and a heel contact plate of the foot pedal in a depressed position in phantom line.

The foot pedal control 10 is shown in FIG. 2 in a center or neutral position. The foot pedal control 10 includes a platform housing 16, which as best shown in FIGS. 4 and 6, has a bottom wall 18 which rests upon the floor. The platform housing 16 has left and right sidewalls 20 and 22, respectively, and a rear wall 24, which project upwardly from the bottom wall 18. The left and right sidewalls 20 and 22, and the rear wall 24 in combination define a three-sided housing with an open forward end and an open top.

Figure 7:
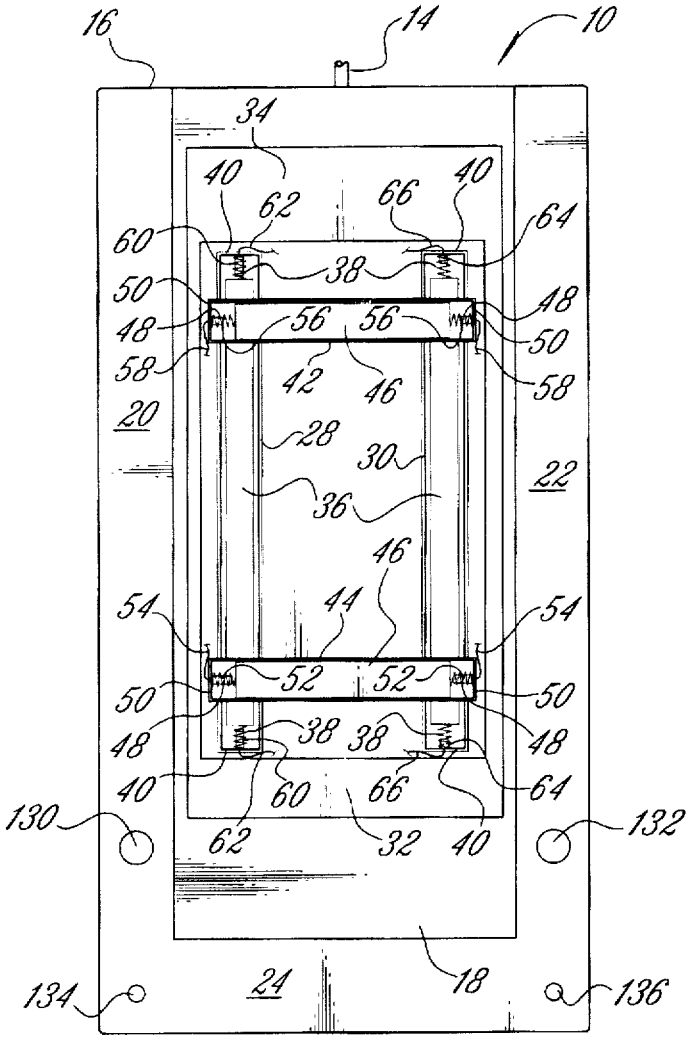
FIG. 7 is a top plan view of the foot pedal control of FIG. 2 shown with the foot pedal and base member removed.

A carriage or base member 26 is movably positioned within the housing 16 for movement within a generally horizontal plane in response to movement of the operator's foot, as will be described in greater detail below. The base member 26 is movably supported above the bottom wall 18 of the housing 16 using a channel and slider arrangement. As best shown in FIGS. 4, 6 and 7, left and right lower channels 28 and 30 are fixedly attached to the bottom wall 18 within the housing 16, and are arranged in parallel spaced-apart relation with each other. The lower channels extend from a rearward position toward a rearward cross wall 32 which projects upward from the bottom wall 18 and which is positioned forward of the rear wall 24, to a forward position toward a forward cross wall 34 which projects upward from the bottom wall. The rearward and forward cross walls 32 and 34 extend laterally toward the left and right sidewalls 20 and 22 of the housing 16.

Each of the left and right lower channels 28 and 30 has an elongated slider 36 slidably disposed therein for free forward and rearward sliding movement within the channel. To bias the slides 36 toward a center or neutral position, a spring 38 is positioned between each end of the slider and a corresponding end wall 40 of the left or right lower channel.

Mounted above and fixedly attached to each of the sliders 36 are forward and rearward laterally extending upper channels 42 and 44, respectively. The forward and rearward upper channels 42 and 44 are arranged in parallel spaced-apart relation with each other and extend transverse to the left and right lower channels 28 and 30. The forward and rearward upper channels 42 and 44 move as a unit with the sliders 36 as they move forwardly and rearwardly within the left and right lower channels 28 and 30.

Each of the forward and rearward upper channels 42 and 44 has an elongated slider 46 slidably disposed therein for free leftward or rightward sliding movement within the channel, independent of any forward and rearward movement of the sliders 36 in the left and right lower channels 28 and 30. To bias the slides 46 toward a center or neutral position, a spring 48 is positioned between each end of the slider and a corresponding end wall 50 of the forward or rearward upper channel.

The base member 26 is fixedly attached to the sliders 46. In response to a force applied by the operator's foot, the base member 26 can freely undergo left or right lateral movement, and forward or rearward movement simultaneously relative to the housing 16. This is a result of the leftward and rightward movement provided by the sliders 46 within the upper channels 42 and 44, and the forward and rearward movement provided by the sliders 36 within the lower channels 28 and 30. With this arrangement, any force applied to the base member 26 to move it in the horizontal plane will result in a component of movement in the forward/rearward direction via the sliders 36, and in the left/right direction via the sliders 46. In such manner, the base member can be moved freely within the horizontal plane along any desired path and at any desired angle.

The left and right movement, and the forward and rearward movement of the base member 26 relative to the housing 16 is detected using eight microswitches for purposes of controlling the left and right directions, and forward and rearward directions of movement of the microscope to provide field-of-view control. A pair of microswitches 52 are positioned within the rearward upper channel 44 with each attached to one of the end walls 50 of the channel and encircled by the corresponding spring 48. The one microswitch 52 is positioned so that when the base member 26 is moved sufficiently leftward, a left end of the slider 46 in the rearward upward channel 44 will contact and actuate the one microswitch, and the other microswitch 52 is positioned so that when the base member is moved sufficiently rightward, a right end of the slider 46 in the rearward upper channel will contact and actuate the other microswitch. In such fashion, if the base member 26 is moved sufficiently to the left or right, the slider 46 in the rearward upper channel 44 will actuate one of the microswitches 52. These microswitches 52 are each connected to wires 54 which exit the housing 16 and form a part of the cable 14. The wires 54 are connected through a speed limiting resistor (not shown) to the circuitry of the microscope 12 which controls the speed of the field-of-view left and right movement of the microscope to produce a slow speed field-of-view adjustment.

To select the fast speed field-of-view left and right movement, another pair of microswitches 56 are positioned within the forward upper channel 42 with each attached to one of the end walls 50 of the channel and encircled by the corresponding spring 48. The one microswitch 56 is positioned so that when the base member 26 is moved sufficiently leftward, the left end of the slider 46 in the forward upper channel 42 will contact and actuate the one microswitch, and the other microswitch 56 is positioned so that when the base member is moved sufficiently rightward, the right end of the slider 46 in the forward upper channel will contact and actuate the other microswitch. These microswitches 56 are each connected to wires 58 which exit the housing 16 and form a part of the cable 14. The wires 58 are connected to the circuitry of the microscope 12 which controls the speed of the field-of-view left and right movement of the microscope to produce a fast speed field-of-view adjustment.

The microswitches 56 have a shorter actuator member than the microswitches 52, and are mounted so that the microswitches 56 will not be actuated by the slider 46 in the forward upper channel 42 until after the movement of the slider 46 in the rearward upper channel 44 first actuates one of the microswitches 52. In such fashion, as the base member 26 is moved to the side, the slider 46 in the rearward upper channel 44 will first engage one of the microswitches 52 to select the slow field-of-view speed for the microscope 12, and only if continued side movement of the base member in the same direction occurs will the slider 46 in the forward upper channel 42 engage one of the microswitches 56 to select the fast field-of-view speed for the microscope. The wires 54 and 58 are connected to the microscope 12 so that left movement of the base member 26 will produce left field-of-view movement of the microscope, and right movement of the base member will produce right field-of-view movement of the microscope.

Forward and rearward movement of the base member 26 is detected to control the field-of-view movement of the microscope in the forward and rearward directions in a similar manner. In particular, a pair of microswitches 60 are positioned within the left lower channel 28 with each attached to one of the end walls 40 of the channel and encircled by the corresponding spring 38. The one microswitch 60 is positioned so that when the base member 26 is moved sufficiently forward, a forward end of the slider 36 in the left lower channel 28 will contact and actuate the one microswitch, and the other microswitch 60 is positioned so that when the base member is moved sufficiently rearward, a rearward end of the slider 36 in the left lower channel will contact and actuate the other microswitch. These microswitches 60 are each connected to wires 62 which exit the housing 16 and form a part of the cable 14. The wires 62 are connected through a speed limiting resistor (not shown) to the circuitry of the microscope 12 which controls the speed of the field-of-view forward and rearward movement of the microscope to produce a slow speed field-of-view adjustment.

To select the fast speed field-of-view forward and rearward movement, another pair of microswitches 64 are positioned within the right lower channel 30 with each attached to one of the end walls 40 of the channel and encircled by the corresponding spring 38. The one microswitch 64 is positioned so that when the base member 26 is moved sufficiently forward, the forward end of the slider 36 in the right lower channel 30 will contact and actuate the one microswitch, and the other microswitch 64 is positioned so that when the base member is moved sufficiently rearward, the rearward end of the slider 36 in the right lower channel will contact and actuate the other microswitch. These microswitches 64 are each connected to wires 66 which exit the housing 16 and form a part of the cable 14. The wires 66 are connected to the circuitry of the microscope 12 which controls the speed of the field-of-view forward and rearward movement of the microscope to produce a fast speed field-of-view adjustment.

The microswitches 64 have a shorter actuator member than the microswitches 60, and are mounted so that the microswitches 64 will not be actuated by the slider 36 in the right lower channel 30 until after the movement of the slider 36 in the left lower channel 28 first actuates one of the microswitches 60. In such fashion, as the base member 26 is moved forward or rearward, the slider 36 in the left lower channel 28 will first engage one of the microswitches 60 to select the slow field-of-view speed for the microscope 12, and only if continued forward or rearward movement of the base member in the same direction occurs will the slider 36 in the right lower channel 30 engage one of the microswitches 64 to select the fast field-of-view speed for the microscope. The wires 62 and 66 are connected to the microscope 12 so that forward movement of the base member 26 will produce forward field-of-view movement of the microscope and rearward movement of the base member will produce rearward field-of-view movement of the microscope.

The foot pedal control 10 includes a foot pedal 70 on which the operator rests his/her foot. The movement of the operator's foot in a horizontal plane while resting on the foot pedal 70 is transmitted to the base member 26 to move the base member relative to the housing 16, and thereby actuate the microswitches 50, 52, 60 and 64 which cause the desired speed and direction of movement of the microscope 12 for field-of-view control, as described above. The foot pedal 70 is also used to provide magnification and focus control, as will be described below.

The foot pedal 70 has a rearward portion 72 and a forward portion 74. A lower side of the rearward portion 72 has a circular wall 76 which projects downwardly therefrom and defines a downwardly opening cylindrical recess 78. The recess 78 is sized to rotatably receive therewithin a cylindrical pivot member 80 which is attached to and projects upwardly from a rearward portion of the base member 26. The foot pedal rearward portion 72 is thereby freely rotatable about a vertical axis of rotation 81 both clockwise and counterclockwise through a horizontal plane relative to the base member 26.

The foot pedal rearward portion 72 is rotatable independent of the base member 26 without producing movement of the base member. However, any left or right, or forward or rearward non-rotational movement of the operator's foot on the foot pedal 70 will be transmitted, through the interconnection of the circular wall 76 of the foot pedal rearward portion 72 and the pivot member 80, to the base member 26, and produce corresponding left or right, or forward or rearward movement thereof. Such non-rotation movement produces movement of the base member 26 through the horizontal plane within which the base member moves as a result of the slider and channel arrangement previously described. As described above, such base member movement controls the speed and direction of movement of the microscope 12 to provide field-of-view control.

The foot pedal forward portion 74 is pivotally attached by a rearward end 82 thereof to a forward end 84 of the foot pedal rearward portion 72 by a pair of transversely extending pivot pins 86. This pivotal connection of the forward and rearward portions of the foot pedal 70 causes them to rotate as a unit through the horizontal plane, but allows the foot pedal forward portion 74 to be independently rotatable in a vertical plane relative to the foot pedal rearward portion 72 about a horizontal axis of rotation. This vertical rotational movement of the foot pedal forward portion 74 is independent of any horizontal rotational movement of the foot pedal rearward portion 72 relative to the base member 26. In such manner, using the force applied to the foot pedal 70 by the operator's foot, the entire foot pedal 70 can be rotated clockwise and counterclockwise through the horizontal plane about the vertical axis of rotation 81 independent of the base member 26, and the foot pedal forward portion 74 can be rotated upward and downward about the horizontal axis of rotation relative to the base member independent of any movement of the foot pedal rearward portion 72 or the base member.

A contact plate 88 is mounted above the foot pedal rearward portion 72 for placement of a heel portion of the operator's foot thereon. A plurality of springs 90 are positioned between the contact plate 88 and an upper side of the foot pedal rearward portion 72 to bias the contact plate into a raised position, as shown in FIG. 4. The foot pedal rearward portion 72 carries a microswitch 92 which projects upward from the rearward portion and is activated by the downward movement of the contact plate 88 as a result of the weight of the operator's foot being placed on the contact plate. The contact plate 88 is shown in the depressed position in phantom line in FIG. 6. The microswitch 92 is connected to wires (not shown) which exit the housing 16 and form a part of the cable 14. These wires are connected to a light of the microscope 12 to control the operation of the light. When the heel portion of the operator's foot is on the contact plate 88, the microswitch 92 turns on the microscope light and when the heel portion of the operator's foot is lifted upward sufficient to release the microswitch 92, the microscope light is turned off.

By using the microswitch 92 mounted under the contact plate 88 to turn on and off the microscope light, the operator of the foot pedal control 10 need only lift his/her heel slightly which allows the springs 90 to push the contact plate upward and away from the microswitch 92 in order to turn the microscope light off without removing his/her foot entirely from the foot pedal 70. This is helpful when a surgeon is performing eye surgery and desires to temporarily turn off the microscope light to avoid unnecessarily shining the light into the patient's eye, but yet does not have his/her hands free to do so and does not wish to remove his/her foot completely from the foot pedal control. This also allows the operator to quickly turn the microscope light back on and resume control of the microscope without having to move his/her foot around blindly searching for the foot pedal 70.

The foot pedal forward portion 74 has a foot engagement surface 94 upon which a forward portion of the operator's foot is positioned when the heel portion of the operator's foot is on the contact plate 88. The engagement surface 94 allows the operator to use the downward movement of the forward portion of his/her foot to transmit downward rotational movement to the foot pedal forward portion 74 and thereby rotate the forward portion downward about the pivot pins 86 relative to the rearward portion 72 and the base member 26. To allow the operator to rotate the foot pedal forward portion 74 upward about the pivot pins 86, the foot pedal forward portion has a rigid foot strap 96 attached thereto. The foot strap 96 is sized to extend about the forward portion of the operator's foot when on the engagement surface 94 and the rearward portion of the operator's foot is on the contact plate 88. The foot strap 96 allows the operator to use the upward movement of the forward portion of his/her foot to transmit upward rotational movement to the foot pedal forward portion 74 and thereby rotate the forward portion upward about the pivot pins 86 relative to the rearward portion 72 and the base member 26.

The foot strap 96 also helps in transmitting clockwise and counterclockwise rotational movements of the user's foot about the vertical axis of rotation 81 to the foot pedal 70. While it is noted that the frictional contact of the operator's foot on the engagement surface 94 and the contact plate 88 will tend to transmit such clockwise and counterclockwise rotational movements of the operator's foot to the foot pedal, the foot strap 96 provides better control since it reduces slippage of the foot on the foot pedal 70.

It is noted that in order to rotate the foot pedal 70 clockwise or counterclockwise relative to the base member 26 without also producing movement of the base member through the base member horizontal plane which adjusts the field-of-view movement of the microscope, it is necessary for the operator to rotate his/her foot on the foot pedal 70 about the vertical axis of rotation 81 which passes through the foot pedal rearward portion 72. This allows the operator to rotate the foot pedal 70 through its horizontal plane without causing movement of the base member 26. However, if desired, this rotation of the foot pedal 70 can be accompanied with movement of the foot pedal in a manner that will also move the base member and hence adjust the field-of-view of the microscope.

The clockwise and counterclockwise rotation of the foot pedal 70 in the horizontal plane is detected using four microswitches for purposes of controlling the zoom-in and zoom-out directions of movement of the microscope to provide magnification control. The upward and downward rotation of the foot pedal forward portion 74 in the vertical plane is detected using four other microswitches for purposes of controlling the focus-down and focus-up directions of movement of the microscope to provide focus control. These microswitches are actuated by an actuation member 100 fixedly attached to a forward end wall of the foot pedal forward portion 74. The actuation member 100 moves to the right and left as the foot pedal 70 rotates clockwise and counterclockwise, respectively, and moves up and down as the foot pedal forward portion 74 rotates upward and downward. The actuation member 100 projects forwardly from the forward end of the foot pedal forward portion 74 into an aperture 102 formed in a forward wall 103 which is attached to and projects upwardly from a forward portion of the base member 26. The aperture 102 has left and right sidewalls **102*a* and 102*b*, respectively, and upper and lower sidewalls 102*c* and 102*d***, respectively.

Figure 5A:
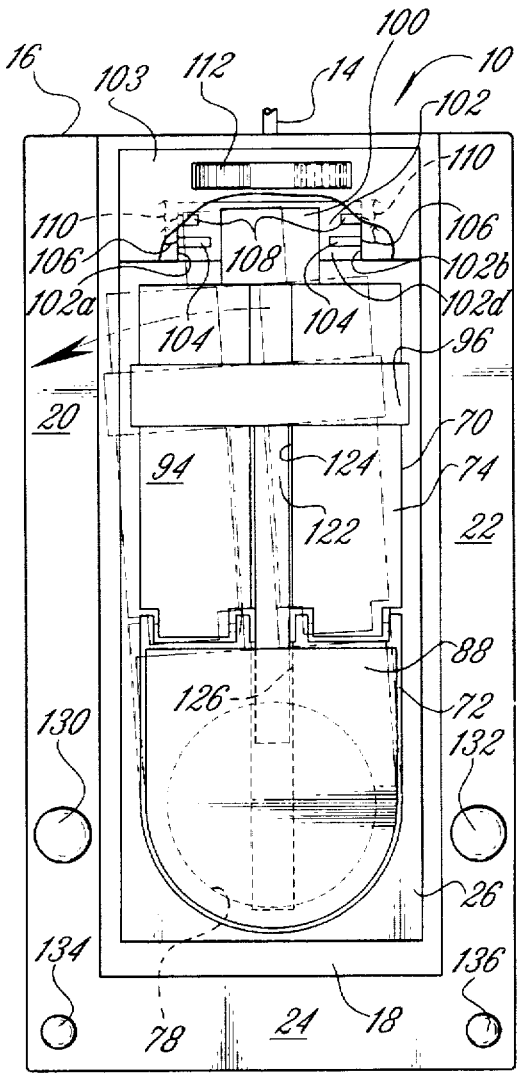
FIG. 5A is a fragmentary top plan view of the foot pedal control of FIG. 2 with the foot pedal shown in phantom line rotated counterclockwise.
Figure 5B:
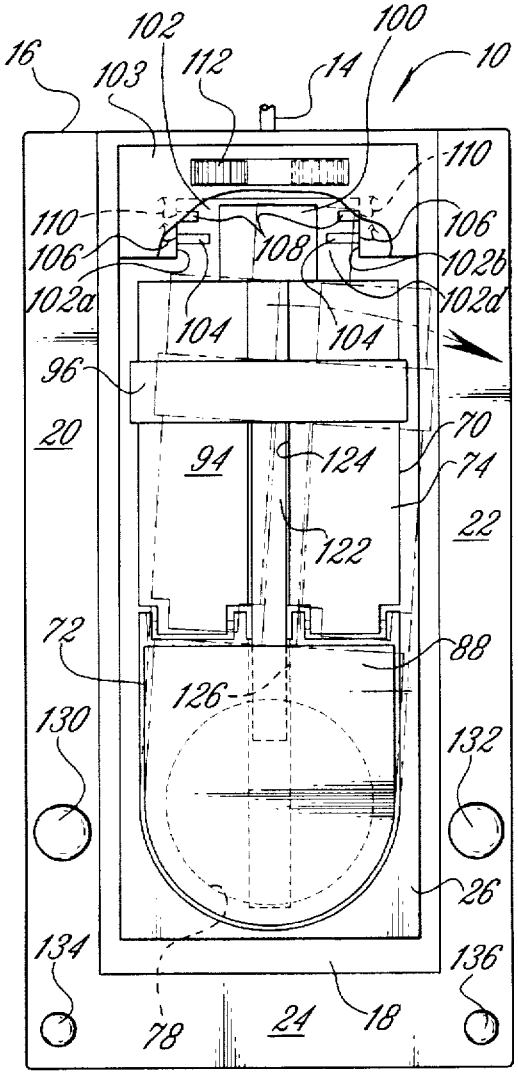
FIG. 5B is a fragmentary top plan view of the foot pedal control of FIG. 2 with the foot pedal shown in phantom line rotated clockwise.

As best shown in FIGS. 5A and 5B, a pair of microswitches 104 are positioned within the aperture 102 with each attached to one of the left and right sidewalls **102*a* and 102*b*. The one microswitch 104 is positioned at the left sidewall 102*a* so that when the foot pedal 70 is rotated sufficiently leftward by rotating it counterclockwise (see FIG. 5A), a left side of the actuation member 100 fixedly attached to the foot pedal forward portion 74 will contact and actuate the one microswitch, and the other microswitch 104 is positioned at the right sidewall 102*b* so that when the foot pedal 70 is rotated sufficiently rightward by rotating it clockwise (see FIG. 5B), a right side of the actuation member will contact and actuate the other microswitch. In such fashion, if the foot pedal 70 is moved sufficiently to the left or right, the actuation member 100 will actuate one of the microswitches 104. These microswitches 104 are each connected to wires 106 which exit the housing 16 and form a part of the cable 14. The wires 106 are connected through a speed limiting resistor (not shown) to the circuitry of the microscope 12** which controls the speed of the zoom-out and zoom-in movement of the microscope to produce a slow speed magnification adjustment.

To select the fast speed zoom-out and zoom-in movement, another pair of microswitches 108 are positioned within the aperture 102 with each attached to one of the left and right sidewalls 102*a* and 102*b*. The one microswitch 108 is positioned at the left sidewall 102*a* so that when the foot pedal 70 is rotated sufficiently leftward by rotating it counterclockwise, the left side of the actuation member 100 will contact and actuate the one microswitch, and the other microswitch 108 is positioned at the right sidewall 102*b* so that when the foot pedal 70 is rotated sufficiently rightward by rotating it clockwise, the right side of the actuation member will contact and actuate the other microswitch. These microswitches 108 are each connected to wires 110 which exit the housing 16 and form a part of the cable 14. The wires 110 are connected to the circuitry of the microscope 12 which controls the speed of the zoom-out and zoom-in movement of the microscope to produce a fast speed magnification adjustment.

The microswitches 108 have a shorter actuator member than the microswitches 104, and are mounted so that the microswitches 108 will not be actuated by the actuation member 100 until after the movement of the actuation member first actuates one of the microswitches 104. In such fashion, as the foot pedal 70 is rotated to the side, the actuation member 100 will first engage one of the microswitches 104 to select the slow zoom speed for the microscope 12, and only if continued side rotation of the foot pedal in the same direction occurs will the actuation member engage one of the microswitches 108 to select the fast zoom speed for the microscope.

The wires 106 and 110 are connected to the microscope 12 so that left rotation of the foot pedal 70 will produce zoom-out movement of the microscope, and right rotation of the foot pedal will produce zoom-in movement of the microscope if a foot selector switch 112 mounted atop the forward wall 103 of the base member 26 is positioned as shown in FIGS. 5A and 5B for left foot operation. When so positioned, the outward rotational movement (counterclockwise) of the operator's left foot causes the microscope to zoom out, while the inward rotational movement (clockwise) causes the microscope to zoom in. The foot selector switch 112 is set before use of the foot pedal control 10 begins based on whether the left or right foot of the operator will be used. If the foot selector switch 112 is positioned as shown in phantom line in FIGS. 5A and 5B for right foot operation, the outward rotational movement (clockwise) of the operator's right foot causes the microscope to zoom out, while the inward rotational movement (counterclockwise) causes the microscope to zoom in.

The actuation member microswitches 104 and 108 have an elongated shape and are aligned vertically so that they will be engaged and moved left or right for their actuation by the actuation member 100 when the foot pedal 70 is rotated counterclockwise or clockwise, without regard for the position to which the foot pedal forward portion 74 has been rotated in the vertical plane.

It is noted that the leftward and rightward movement of the base member 26 described above to provide the field-of-view control, which carries the foot pedal 70 therewith, does not rotate the foot pedal left or right to cause the actuation member 100 to engage and actuate the microswitches 104 and 108 used for magnification control. The magnification control is only achieved by intentionally rotating the foot pedal 70 clockwise or counterclockwise relative to the base member 26 which supports the microswitches 104 and 108.

Upward and downward rotational movement of the foot pedal forward portion 74 is detected to control the focus movement of the microscope in the focus-up and focus-down directions in a similar manner, although the microswitches used are mounted in different locations. As best shown in FIGS. 4 and 6, a pair of microswitches 114 are positioned within the aperture 102 with each attached to one of the upper and lower sidewalls 102*c* and 102*d*. One microswitch 114 is positioned at the upper sidewall 102*c* so that when the foot pedal forward portion 74 is rotated sufficiently upward, an upper side of the actuation member 100 will contact and actuate the one microswitch, and the other microswitch 114 is positioned at the lower sidewall 102*d* so that when the foot pedal forward portion is rotated sufficiently downward, a lower side of the actuation member will contact and actuate the other microswitch. These microswitches 114 are each connected to wires 116 which exit the housing 16 and form a part of the cable 14. The wires 116 are connected through a speed limiting resistor (not shown) to the circuitry of the microscope 12 which controls the speed of the focus-up and focus-down movement of the microscope to produce a slow speed focus adjustment.

To select the fast speed focus-up and focus-down movement, another pair of microswitches 118 are positioned within the aperture 102 with each attached to one of the upper and lower sidewalls 102*c* and 102*d*. One microswitch 118 is positioned at the upper sidewall 102*c* so that when the foot pedal forward portion 74 is rotated sufficiently upward, the upper side of the actuation member 100 will contact and actuate the one microswitch, and the other microswitch 118 is positioned at the lower sidewall 102*d* so that when the foot pedal forward portion is rotated sufficiently downward, the lower side of the actuation member will contact and actuate the other microswitch. These microswitches 118 are each connected to wires 120 which exit the housing 16 and form a part of the cable 14. The wires 120 are connected to the circuitry of the microscope 12 which controls the speed of the focus-up and focus-down movement of the microscope to produce a fast speed focus adjustment.

The microswitches 118 have a shorter actuator member than the microswitches 114, and are mounted so that the microswitches 118 will not be actuated by the actuation member 100 until after its movement first actuates one of the microswitches 114. In such fashion, as the foot pedal forward portion 74 is rotated upward or downward, the actuation member 100 will first engage one of the microswitches 114 to select the slow focus speed for the microscope 12, and only if continued upward or downward rotation of the foot pedal forward portion in the same direction occurs will the actuation member engage one of the microswitches 118 to select the fast Locus speed for the microscope. The wires 116 and 120 are connected to the microscope 12 so that upward rotation of the foot pedal forward portion 74 will produce focus-up movement of the microscope and downward rotation of the foot pedal forward portion will produce focus-down movement of the microscope.

It is noted that all the previously described control of the speed and direction of movement of the microscope 12 for field-of-view, magnification and focus control, as well as operation of the microscope light, is achieved without the operator having to remove his/her foot from the foot pedal 70 and with a single directional movement of the foot. Furthermore, one or all three of the field-of-view, magnification and focus control can be adjusted at the same time at either the slow or fast speed, by the operator selectively moving his/her foot non-rotationally to move the base member 26 in the horizontal plane, rotationally about the axis of rotation 81 to rotate the foot pedal in the horizontal plane, and rotationally about the pivot pins 86 to rotate the foot pedal forward portion 74 in the vertical plane.

As best shown in FIG. 2, the foot strap 96 is fixedly attached to an elongated slider member 122 slidably disposed in a forwardly extending retainer groove 124 in the foot pedal forward portion 74 and a forwardly extending retainer groove 126 in the foot pedal rearward portion 72 which is in longitudinal alignment with the forward retainer groove 124. The slider member 122 can be slid forward or rearward in the retainer grooves 124 and 126 to adjust the position of the foot strap 96 on the foot pedal forward portion 74 according to the length of the operator's foot.

The slider member 122 is retained in the forward retainer groove 124 against upward movement relative to the foot pedal forward portion 74 to transmit upward movement of the forward portion of the operator's foot applied to the foot strap 96, to the foot pedal forward portion and thereby rotate the foot pedal forward portion upward about the pivot pins 86.

The slider member 122 is also retained in the rearward retainer groove 126 against upward movement relative to the foot pedal rearward portion 72. The slider member 122 is fabricated from a resilient material so that when the foot pedal forward portion 74 is rotated upward or downward, the resiliency of the slider member will apply a biasing return force on the foot pedal forward portion to help return and hold it in a center or neutral position shown in FIGS. 4 and 6. The resiliency of the slider member 122 also provides a resistance when flexed to create a proper tactile feel when rotating the foot pedal forward portion upward and downward. This feel can also be achieved by using an adjustable tension hinge as the pivot pins 86. A spring 128 is positioned between the foot pedal forward portion 74 and the base member 26 to also assist in returning and holding the foot pedal forward portion in the neutral position. The spring 128 also returns the foot pedal 70 to the neutral position after being rotated counterclockwise or clockwise.

The foot pedal control 10 provides additional secondary control features which do require removal of the operator's foot from the foot pedal 70. The features are controlled by foot-activated switches mounted atop the left and right sidewalls 20 and 22 of the housing 16. This includes a two-position light control switch 130 which in a first position activates the microswitch 92 to allow its control of the microscope light in response to the position of the contact plate 88, as described above, and which in a second position deactivates the microswitch 92 so that it provides no control of the microscope light and the microscope light remains on as long as the main light switch on the microscope is turned on.

An auxiliary instrument switch 132 allows the turning on and off of an auxiliary instrument (not shown) to which it is connected. A first slitlamp control switch 134 allows positioning control of the movement of a slitlamp (not shown) to the left, and a second slitlamp control switch 136 allows positioning control of the movement of the slitlamp to the right.

It is noted that while microswitches have been described to detect movement of the base member 26 and the foot pedal, other sensors may be used such as optical detectors.

Figure 8:
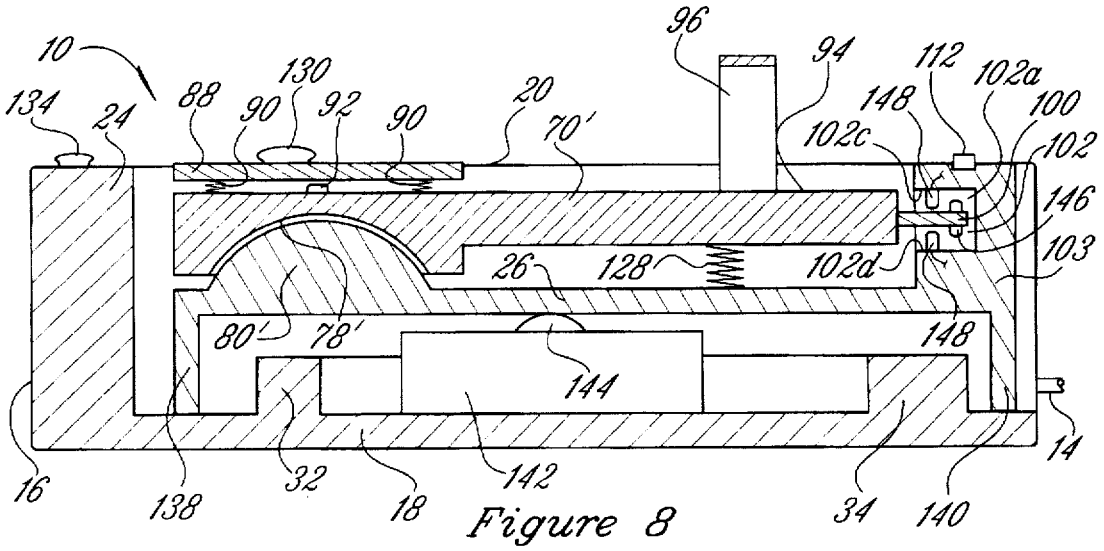
FIG. 8 is a cross-sectional view of an alternative embodiment of the foot pedal control of FIG. 1 using a trackball for detecting movement of the base member in a horizontal plane.

An alternative embodiment of the foot pedal control 10 is shown in FIG. 8. In this embodiment, a single piece foot pedal 70' is used which has a cup recess 78' to rotatably receive a half-ball-shaped pivot member 80' to permit clockwise and counterclockwise movement of the foot pedal to each side independent of the base member 26, and upward and downward movement of the foot pedal independent of the base member to selectively actuate the microswitches 104, 108, 114 and 118 for magnification and focus control.

In the embodiment of FIG. 8, the slider and channel arrangement which allows free movement of the base member 26 in the horizontal plane relative to the housing 16, and the associated microswitches 52, 56, 60 and 64 for field-of-view control, are replaced with leg supports 138 and 140 which project downwardly from the base member and slidably engage the bottom wall 18 of the housing 16, and a conventional trackball directional device 142 which has a trackball 144 in rolling engagement with an underside of the base member. As the base member 26 is moved about in response to movements of the operator's foot on the foot pedal 70', the trackball 144 rotates and the device 142 sends directional signals to the microscope 12. In this fashion, the movement of the base member 26 in the horizontal plane relative to the housing 16 is sensed and the directional signals can be used to produce field-of-view movements of the microscope 12 that correspond to the movement of the base member. This allows a continuously adjustable control of the field-of-view position of the microscope in response to movement of the base member by the operator.

The embodiment of FIG. 8 also uses a pair of variable position slider switches 146 to detect the clockwise and counterclockwise rotational position of the foot pedal 70' to provide continuously adjustable control of the speed at which the microscope 12 zooms in or out in response to rotational movement of the foot pedal in the horizontal plane. A pair of variable position slider switches 148 are used to detect the upward and downward rotational position of the foot pedal 70' to provide continuously adjustable control of the speed at which the microscope focuses up and down in response to rotational movement of the foot pedal in the vertical plane.

It is noted that the use of two microswitches to control the speed of the field-of-view, zoom and focus movements in any one direction will provide variable speed control when the foot pedal control 10 is used with a microscope which does not itself have variable operating speeds. With the use of two microswitches, slow and fast speed control is achieved. Using the variable position slider switches 146 and 148 of the embodiment of FIG. 8 an infinitely variable speed control is provided even for a microscope which does not itself have variable operating speeds.

It will be appreciated that, although specific embodiments of the invention have been described herein for purposes of illustration, various modifications may be made without departing from the spirit and scope of the invention. Accordingly, the invention is not limited except as by the appended claims.

I claim:

1. A foot pedal control for a microscope adjustably movable in the left and right directions, and in the forward and rearward directions, to provide field-of-view control, adjustably movable to zoom in and out to provide magnification control, and adjustably movable to focus up and down to provide focus control, all in response to the movement of a user's foot, comprising:

a platform having forward and rearward ends, and left and right sides;

a base member movably mounted on said platform to permit left and right lateral movement and forward and rearward movement simultaneously relative to said platform, said base member having a forward portion and a rearward portion;

a left actuation switch electrically connectable to the microscope to actuate movement thereof in one of the left and right directions in response to movement of said base member to the left relative to said platform;

a right actuation switch electrically connectable to the microscope to actuate movement thereof in the other of the left and right directions in response to movement of said base member to the right relative to said platform;

a forward actuation switch electrically connectable to the microscope to actuate movement thereof in the forward direction in response to forward movement of said base member relative to said, platform;

a rearward actuation switch electrically connectable to the microscope to actuate movement thereof in the rearward direction in response to rearward movement of said base member relative to said platform;

a rearward member positioned above said base member rearward portion, said rearward member having a contact portion for placement of a heel portion of the user's foot thereon, said rearward member being attached to said base member rearward portion to permit clockwise and counterclockwise rotational movement relative thereto through a generally horizontal plane independent of said base member, and to transmit left and right lateral movements and forward and rearward movements of the user's foot to said base member to produce corresponding movement of said base member relative to said platform;

a forward member positioned above said base member forward portion, said forward member being attached to said rearward member for rotational movement therewith through said horizontal plane and to permit rotational movement through a generally vertical plane relative to said rearward member, said forward member having a contact portion for placement of a forward portion of the user's foot thereon to transmit upward and downward movement of the forward portion of the user's foot to said forward member to rotate said forward member through said vertical plane;

a foot engagement member attached to said forward member extending at least partially around the forward portion of the user's foot when on said forward member contact portion, said foot engagement member transmitting clockwise and counterclockwise rotational movements of the user's foot to said forward member for rotational movement of said forward and rearward members together through said horizontal plane, and transmitting upward movements of the forward portion of the user's foot to said forward member to rotate said forward member upward in said vertical plane relative to said rearward member;

a first zoom actuation switch electrically connectable to the microscope to actuate movement thereof in one of the zoom-in and zoom-out directions in response to clockwise movement of said forward member relative to said base member;

a second zoom actuation switch electrically connectable to the microscope to actuate movement thereof in the other of the zoom-in and zoom-out directions in response to counterclockwise movement of said forward member relative to said base member;

a first focus actuation switch electrically connectable to the microscope to actuate movement thereof in one of the focus-up and focus-down directions in response to upward movement of said forward member relative to said base member; and a second focus actuation switch electrically connectable to the microscope to actuate movement thereof in the other of the focus-up and focus-down directions in response to downward movement of said forward member relative to said base member.

2. The foot pedal control of claim 1 wherein said rearward member includes a lower portion to which said forward member is pivotally attached, and said rearward member contact portion is a contact plate vertically movable relative to said rearward member lower portion, and the foot pedal control further includes a light switch electrically connectable to the microscope, said light switch being placed in an on state in response to the user's foot being on said contact plate and being placed in an off state in response to the user's foot being off said contact plate.

3. The foot pedal control of claim 2, further including a foot activated control switch mounted on said platform and electrically connected to said light switch to selectively activate and deactivate said light switch.

4. The foot pedal control of claim 1 wherein each of said first and second zoom switches includes a slow switch and a fast switch, with said slow switch being first engaged in response to rotational movement of said forward member in said horizontal plane and then said fast switch being next engaged in response to further rotational movement of said forward member in the same rotational direction, whereby initial rotation of said forward member in said horizontal plane results in a slow zoom speed selection and further rotation of said forward member in the same direction results in a fast zoom speed selection.

5. The foot pedal control of claim 1 wherein each of said first and second focus switches includes a slow switch and a fast switch, with said slow switch being first engaged in response to movement of said forward member in said vertical plane and then said fast switch being next engaged in response to further movement of said forward member in the same direction, whereby initial movement of said forward member in said vertical plane results in a slow focus speed selection and further movement of said forward member in the same direction results in a fast focus speed selection.

6. The foot pedal control of claim 1 wherein each of said left, right, forward and rearward switches includes a slow switch and a fast switch, with said slow switch being first engaged in response to movement of said base member and then said fast switch being next engaged in response to further movement of said base member in the same direction, whereby initial movement of said base member results in a slow field-of-view speed selection and further movement of said base member in the same direction results in a fast field-of-view speed selection.

7. The foot pedal control of claim 1 wherein said forward member is pivotally attached to said rearward member to permit rotation of said forward member through said vertical plane.

8. The foot pedal control of claim 1, further including a user actuatable selection switch electrically connected to said first and second zoom switches and actuatable to select microscope zoom operation in a first mode with rotation of said forward member clockwise actuating movement of the microscope in the zoom-out direction and rotation of said forward member counterclockwise actuating movement of the microscope in the zoom-in direction, and a second mode with rotation of said forward member clockwise actuating movement of the microscope in the zoom-in direction and rotation of said forward member counterclockwise actuating movement of the microscope in the zoom-out direction, whereby the user can actuate said selection switch to operate in one of said first or second modes which best suits the left or right foot being used by the user to operate the foot pedal control.

9. The foot pedal control of claim 1 wherein each of said first and second zoom switches is a variable position speed control switch which adjusts the zoom speed of movement of the microscope in response to the extent of rotational movement of said forward member in said horizontal plane.

10. The foot pedal control of claim 1 wherein each of said first and second focus switches is a variable position speed control switch which adjusts the focus speed of movement of the microscope in response to the extent of movement of said forward member in said vertical plane.

11. A foot pedal control for a microscope adjustably movable in first, second, third and fourth directions within a generally horizontal plane to provide field-of-view control, adjustably movable to zoom in and out to provide magnification control, and adjustably movable to focus up and down to provide focus control, all in response to the movement of a user's foot, comprising:

a platform having forward and rearward ends, and left and right sides;

a base member movably mounted on said platform to permit left and right lateral movement and forward and rearward movement simultaneously relative to said platform;

a left actuation switch electrically connectable to the microscope to actuate movement thereof in the first direction within the generally horizontal plane in response to movement of said base member to the left relative to said platform;

a right actuation switch electrically connectable to the microscope to actuate movement thereof in the second direction within the generally horizontal plane in response to movement of said base member to the right relative to said platform;

a forward actuation switch electrically connectable to the microscope to actuate movement thereof in the third direction within the generally horizontal plane in response to forward movement of said base member relative to said platform;

a rearward actuation switch electrically connectable to the microscope to actuate movement thereof in the fourth direction within the generally horizontal plane in response to rearward movement of said base member relative to said platform;

a first member having a contact portion for placement of one of a heel portion and a forward portion of the user's foot thereon, said first member being attached to said base member to permit clockwise and counterclockwise rotational movement relative thereto through a generally horizontal plane independent of said base member, and to transmit left and right lateral movements and forward and rearward movements of the user's foot to said base member to produce corresponding movement of said base member relative to said platform;

a second member attached to said first member for rotational movement therewith through said horizontal plane, said second member being rotatably movable through a generally vertical plane relative to said base member, said second member having a contact portion for placement of the other of the heel portion and forward portion of the user's foot thereon to transmit upward and downward movement of the other portion of the user's foot to said second member to rotate said second member through said vertical plane;

a first zoom actuation switch electrically connectable to the microscope to actuate movement thereof in one of the zoom-in and zoom-out directions in response to clockwise movement of said second member relative to said base member;

a second zoom actuation switch electrically connectable to the microscope to actuate movement thereof in the other of the zoom-in and zoom-out directions in response to counterclockwise movement of said second member relative to said base member;

a first focus actuation switch electrically connectable to the microscope to actuate movement thereof in one of the focus-up and focus-down directions in response to upward movement of said second member relative to said base member; and a second focus actuation switch electrically connectable to the microscope to actuate movement thereof in the other of the focus-up and focus-down directions in response to downward movement of said second member relative to said base member.

12. The foot pedal control of claim 11 wherein one of said first and second members supports a contact plate for movement vertically relative thereto, and the foot pedal control further includes a light switch electrically connectable to the microscope, said light switch being placed in an on state in response to the user's foot being on said contact plate and being placed in an off state in response to the user's foot being off said contact plate.

13. The foot pedal control of claim 11 wherein each of said first and second zoom switches includes a slow switch and a fast switch, with said slow switch being first engaged in response to rotational movement of said second member in said horizontal plane and then said fast switch being next engaged in response to further rotational movement of said second member in the same rotational direction, whereby initial rotation of said second member in said horizontal plane results in a slow zoom speed selection and further rotation of said second member in the same direction results in a fast zoom speed selection.

14. The foot pedal control of claim 11 wherein each of said first and second focus switches includes a slow switch and a fast switch, with said slow switch being first engaged in response to movement of said second member in said vertical plane and then said fast switch being next engaged in response to further movement of said second member in the same direction, whereby initial movement of said second member in said vertical plane results in a slow focus speed selection and further movement of said second member in the same direction results in a fast focus speed selection.

15. The foot pedal control of claim 11 wherein each of said left, right, forward and rearward switches includes a slow switch and a fast switch, with said slow switch being first engaged in response to movement of said base member and then said fast switch being next engaged in response to further movement of said base member in the same direction, whereby initial movement of said base member results in a slow field-of-view speed selection and further movement of said base member in the same direction results in a fast field-of-view speed selection.

16. The foot pedal control of claim 11 wherein said first and second members are pivotally attached together to permit rotation of said second member through said vertical plane.

17. The foot pedal control of claim 11 wherein each of said first and second zoom switches is a variable position speed control switch which adjusts the zoom speed of movement of the microscope in response to the extent of rotational movement of said second member in said horizontal plane.

18. The foot pedal control of claim 11 wherein each of said first and second focus switches is a variable position speed control switch which adjusts the focus speed of movement of the microscope in response to the extent of movement of said second member in said vertical plane.

19. A foot pedal control for a microscope adjustably movable in first, second, third and fourth directions within a generally horizontal plane to provide field-of-view control, and adjustably movable in fifth, sixth, seventh and eighth directions, each to provide one of zoom in magnification control, zoom out magnification control, focus up focus control and focus down focus control, all in response to the movement of a user's foot, comprising:

a platform;

a first member movably mounted on said platform to permit left and right lateral movement and forward and rearward movement simultaneously relative to said platform;

a left actuation sensor connectable to the microscope to actuate movement thereof in the first direction within the generally horizontal plane in response to movement of said first member to the left relative to said platform;

a right actuation sensor connectable to the microscope to actuate movement thereof in the second direction within the generally horizontal plane in response to movement of said first member to the right relative to said platform;

a forward actuation sensor connectable to the microscope to actuate movement thereof in the third direction within the generally horizontal plane in response to forward movement of said first member relative to said platform;

a rearward actuation sensor connectable to the microscope to actuate movement thereof in the fourth direction within the generally horizontal plane in response to rearward movement of said first member relative to said platform;

a second member having a first contact portion for placement of one of a heel portion and a forward portion of the user's foot thereon, and a second contact portion for placement of the other of the heel portion and forward portion of the user's foot thereon, said first contact portion being attached to said first member to permit clockwise and counterclockwise rotational movement relative thereto through a generally horizontal plane independent of said first member, and to transmit left and right lateral movements and forward and rearward movements of the user's foot to said first member to produce corresponding movement of said first member relative to said platform, said second contact portion being attached to said first contact portion for rotational movement therewith through said horizontal plane, said second contact portion being rotatably movable through a generally vertical plane relative to said platform in response to upward and downward movement of the other of the heel portion and forward portion of the user's foot on said second contact portion to rotate said second contact portion through said vertical plane;

a first actuation sensor connectable to the microscope to actuate movement thereof in the fifth direction in response to clockwise movement of said second contact portion relative to said first member;

a second actuation sensor connectable to the microscope to actuate movement thereof in the sixth direction in response to counterclockwise movement of said second contact portion relative to said first member;

a third actuation sensor connectable to the microscope to actuate movement thereof in the seventh direction in response to upward movement of said second contact portion relative to said platform; and a fourth actuation sensor connectable to the microscope to actuate movement thereof in the eighth direction in response to downward movement of said second contact portion relative to said platform.

20. The foot pedal control of claim 19 wherein said second member supports a contact plate for movement vertically relative thereto, and the foot pedal control further includes a light sensor connectable to the microscope, said light switch being placed in an on state in response to the user's foot being on said contact plate and being placed in an off state in response to the user's foot being off said contact plate.

21. The foot pedal control of claim 19 wherein each of said first and second sensors includes a slow sensor and a fast sensor, with said slow sensor first sensing rotational movement of said second contact portion in said horizontal plane and then said fast sensor next sensing further rotational movement of said second contact portion in the same rotational direction, whereby initial rotation of said second contact portion in said horizontal plane results in a slow speed selection and further rotation of said second contact portion in the same direction results in a fast speed selection.

22. The foot pedal control of claim 19 wherein each of said third and fourth sensors includes a slow sensor and a fast sensor, with said slow sensor first sensing movement of said second contact portion in said vertical plane and then said fast sensor next sensing further movement of said second contact portion in the same direction, whereby initial movement of said second contact portion in said vertical plane results in a slow speed selection and further movement of said second contact portion in the same direction results in a fast speed selection.

23. The foot pedal control of claim 19 wherein each of said left, right, forward and rearward sensors includes a slow sensor and a fast sensor, with said slow sensor first sensing movement of said first member and then said fast sensor next sensing further movement of said first member in the same direction, whereby initial movement of said first member results in a slow field-of-view speed selection and further movement of said first member in the same direction results in a fast field-of-view speed selection.

24. The foot pedal control of claim 19 wherein said first and second contact portions are pivotally attached together to permit rotation of said second contact portion through said vertical plane.

25. The foot pedal control of claim 19 wherein each of said first and second sensors is a variable position speed control sensor which adjusts the speed of movement of the microscope in response to the extent of rotational movement of said second contact portion in said horizontal plane.

26. The foot pedal control of claim 19 wherein each of said third and fourth sensors is a variable position speed control sensor which adjusts the speed of movement of the microscope in response to the extent of movement of said second contact portion in said vertical plane.

27. A foot pedal control for a microscope adjustably movable in opposing first and second microscope directions, adjustably movable in opposing third and fourth microscope directions, adjustably movable in opposing fifth and sixth microscope directions, and adjustably movable in opposing seventh and eighth microscope directions, all in response to the movement of a user's foot, comprising:

a first member movably mounted to permit non-rotational movement thereof through a first plane in opposing first and second member directions and in opposing third and fourth member directions different from said first and second member directions;

a first actuation sensor connectable to the microscope to actuate movement thereof in the first microscope direction in response to movement of said first member in said first member direction;

a second actuation sensor connectable to the microscope to actuate movement thereof in the second microscope direction in response to movement of said first member in said second member direction;

a third actuation sensor connectable to the microscope to actuate movement thereof in the third microscope direction in response to movement of said first member in said third member direction;

a fourth actuation sensor connectable to the microscope to actuate movement thereof in the fourth microscope direction in response to movement of said first member in said fourth member direction;

a second member having a first contact portion for placement of one of a heel portion and a forward portion of the user's foot thereon, and a second contact portion for placement of the other of the heel portion and forward portion of the user's foot thereon, said first contact portion being attached to said first member to permit clockwise and counterclockwise rotational movement relative thereto independent of said first member in response to clockwise and counterclockwise rotational movement of the one of the heel portion and forward portion of the user's foot on said first contact portion to rotate said first contact portion in clockwise and counterclockwise directions, and to transmit movements of the user's foot in said first, second, third and fourth member directions in said first plane to said first member to produce corresponding movement of said first member, said second contact portion being attached to said first contact portion for clockwise and counterclockwise rotational movement therewith, said second contact portion being upward and downward rotatably movable relative to said first member in response to upward and downward movement of the other of the heel portion and forward portion of the user's foot on said second contact portion to rotate said second contact portion in upward and downward directions;

a fifth actuation sensor connectable to the microscope to actuate movement thereof in the fifth microscope direction in response to clockwise rotational movement of said second contact portion relative to said first member;

a sixth actuation sensor connectable to the microscope to actuate movement thereof in the sixth microscope direction in response to counterclockwise rotational movement of said second contact portion relative to said first member;

a seventh actuation sensor connectable to the microscope to actuate movement thereof in the seventh microscope direction in response to upward rotational movement of said second contact portion; and an eighth actuation sensor connectable to the microscope to actuate movement thereof in the eighth microscope direction in response to downward rotational movement of said second contact portion.

28. The foot pedal control of claim 27 wherein each of said fifth and sixth sensors includes a slow sensor and a fast sensor, with said slow sensor first sensing rotational movement of said second contact portion relative to said first member and then said fast sensor next sensing further rotational movement of said second contact portion in the same rotational direction, whereby initial rotation of said second contact portion relative to said first member results in a slow speed selection and further rotation of said second contact portion in the same direction results in a fast speed selection.

29. The foot pedal control of claim 27 wherein each of said seventh and eighth sensors includes a slow sensor and a fast sensor, with said slow sensor first sensing rotational movement of said second contact portion relative to said first member and then said fast sensor next sensing further rotational movement of said second contact portion in the same direction, whereby initial rotation of said second contact portion relative to said first member results in a slow speed selection and further rotation of said second contact portion in the same direction results in a fast speed selection.

30. The foot pedal control of claim 27 wherein each of said first, second, third and fourth sensors includes a slow sensor and a fast sensor, with said slow sensor first sensing movement of said first member and then said fast sensor next sensing further movement of said first member in the same direction, whereby initial movement of said first member results in a slow speed selection and further movement of said first member in the same direction results in a fast speed selection.

31. The foot pedal control of claim 27, wherein said first and second contact portions are pivotally attached together to permit rotation of said second contact portion through a substantially vertical plane.

32. The foot pedal control of claim 27 wherein each of said fifth and sixth sensors is a variable position speed control sensor which adjusts the speed of movement of the microscope in response to the extent of clockwise and counterclockwise rotational movement of said second contact portion relative to said first member.

33. The foot pedal control of claim 27 wherein each of said seventh and eighth sensors is a variable position speed control sensor which adjusts the speed of movement of the microscope in response to the extent of upward and downward rotational movement of said second contact portion relative to said first member.

* * * * *